US006620312B1

(12) United States Patent
Murphy et al.

(10) Patent No.: US 6,620,312 B1
(45) Date of Patent: Sep. 16, 2003

(54) PROCESS FOR MAKING A LUBE BASESTOCK WITH EXCELLENT LOW TEMPERATURE PROPERTIES

(75) Inventors: William John Murphy, Baton Rouge, LA (US); Ian Alfred Cody, Baton Rouge, LA (US); Bernard George Silbernagel, Annandale, NJ (US)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/601,481

(22) PCT Filed: Feb. 12, 1999

(86) PCT No.: PCT/US99/03007

§ 371 (c)(1),
(2), (4) Date: Oct. 25, 2000

(87) PCT Pub. No.: WO99/41335

PCT Pub. Date: Aug. 19, 1999

Related U.S. Application Data

(60) Provisional application No. 60/074,617, filed on Feb. 13, 1998.

(51) Int. Cl.[7] ..... C10G 69/02; C10G 69/04

(52) U.S. Cl. ..... 208/58; 208/88; 208/89; 208/18; 208/134; 208/135; 208/137; 208/209; 208/254 H; 208/60; 208/61; 208/78; 208/79; 585/310; 585/734; 585/739

(58) Field of Search ..... 208/18, 134, 135, 208/137, 209, 254 H, 88, 89, 78, 79, 58, 60, 61; 585/310, 734, 739

(56) References Cited

U.S. PATENT DOCUMENTS

| | | | | |
|---|---|---|---|---|
| 3,880,746 | A | 4/1975 | Bennett et al. | 208/59 |
| 4,622,129 | A | 11/1986 | Bayle et al. | 208/87 |
| 4,728,415 | A | 3/1988 | Unmuth et al. | 208/87 |
| 4,764,265 | A | 8/1988 | Bijwaard et al. | 208/18 |
| 4,853,104 | A | 8/1989 | Degnan et al. | 208/61 |
| 4,913,797 | A | 4/1990 | Albinson et al. | 208/89 |
| 4,943,672 | A | 7/1990 | Hamner et al. | 585/737 |
| 4,960,504 | A | 10/1990 | Pellet et al. | 208/411 |
| 5,135,638 | A | 8/1992 | Miller | 208/27 |
| 5,139,647 | A | 8/1992 | Miller | 208/100 |
| 5,246,566 | A | 9/1993 | Miller | 208/27 |
| 5,723,716 | A | 3/1998 | Brandes et al. | 585/734 |
| 5,834,522 | A | 11/1998 | Mignard et al. | 518/700 |

*Primary Examiner*—Nadine G. Norton
(74) *Attorney, Agent, or Firm*—Jeremy J. Kliebert

(57) ABSTRACT

A method for producing a lube basestock from a waxy feed is disclosed in which a feed containing to 50 wt % or more of wax is hydrotreated and stripped to lower the nitrogen and sulfur content of the feed. The feed is then hydroisomerized under conditions to 370° C. hydrocatalytically dewaxed with a catalyst comprising a mixture of a catalytically active metal on a zeolite dewaxing catalyst and an amorphous catalyst, or alternatively is solvent dewaxed and then hydrocatalytically dewaxed with the just described catalyst.

7 Claims, 4 Drawing Sheets

PROCESS FOR MAKING A LUBE BASESTOCK WITH EXCELLENT LOW TEMPERATURE PROPERTIES

This application claims benefit of provisional application No. 60/074,617 filed Feb. 13, 1998.

FIELD OF THE INVENTION

This invention relates to the catalytic treatment of waxy feeds including slack wax, Fischer-Tropsch wax, waxy raffinates and waxy distillates to produce a high quality lube oil product having a unique structural character, a low pour point and viscosity, and a high viscosity index (VI).

BACKGROUND OF THE INVENTION

The isomerization of wax and waxy feeds to liquid products boiling in the lube oil boiling range and catalysts useful in such practice are well known in the literature. Preferred catalysts in general comprise noble Group VIII metals on halogenated refractory metal oxide support, e.g. platinum on fluorided alumina. Other useful catalysts can include noble Group VIII metals on refractory metal oxide support such as silica/alumina which has their acidity controlled by use of dopants such as yttria. As useful as isomerization processes may be, in general they do not improve the pour point of the feed subjected to isomerization.

Catalytic dewaxing is also a process well documented in the literature. As is known, catalytic dewaxing generally leads to lubes with low pour point; however, the VI also tends to be lower as a result of such processing.

Extensive investigations have been conducted in an effort to develop new and improved catalysts and processing schemes for preparing high quality lubes having a low pour point and a high VI.

SUMMARY OF THE INVENTION

It has now been discovered that waxy feeds such as those containing greater than 50 wt % wax can be treated so as to produce a lube oil product having a unique structural character, excellent low temperature properties and a high VI. The invention relates to a method for producing a lube basestock from a feed containing 50 wt % or more of wax comprising:

(a) hydrotreating the feed under hydrotreating conditions so as to reduce the sulfur and nitrogen content thereof;

(b) hydroisomerizing at least a portion of the hydrotreated feed under hydroisomerization conditions to reduce the wax content in the feed to less than about 40 wt %;

(c) separating the hydroisomerizated feed of step (b) to obtain a lube fraction boiling above about 340° C.;

(d) processing at least a portion of the lube fraction of step (c) under hydrocatalytic dewaxing conditions with a catalyst comprising at least one active metal hydrogenation component on a dewaxing catalyst and at least one active metal hydrogenation component on an amorphous hydroisomerization catalyst.

Another embodiment of the invention comprises a method for producing a lube basestock from a feed containing 50 wt % or more of wax comprising:

(a) hydrotreating waxy feed under hydrotreating conditions sufficient to reduce the sulfur and nitrogen content thereof to produce a hydrotreated feed;

(b) hydroisomerizing at least a portion of the hydrotreated feed under hydroisomerization conditions sufficient to reduce the wax content in the feed to about 35 wt % or less;

(c) separating the hydroisomerized feed of step (b) to obtain a lube fraction boiling above about 340° C.;

(d) solvent dewaxing the lube fraction to a pour point of from about +10° C. to about −20° C. to obtain a dewaxed feed;

(e) processing at least a portion of the dewaxed feed under hydro-catalytic dewaxing conditions with a unitized powder pellet catalyst comprising at least one active metal component on a 10 member ring unidirectional pore inorganic oxide molecular sieve and at least one active metal component on an isomerization component selected from refractory metal oxides and refractory metal oxides including a dopant.

Importantly, the processes of the present invention provides high yield of basestock based on feed.

These and other embodiments of the invention will be discussed below.

DESCRIPTION OF THE INVENTION

Figure 1:
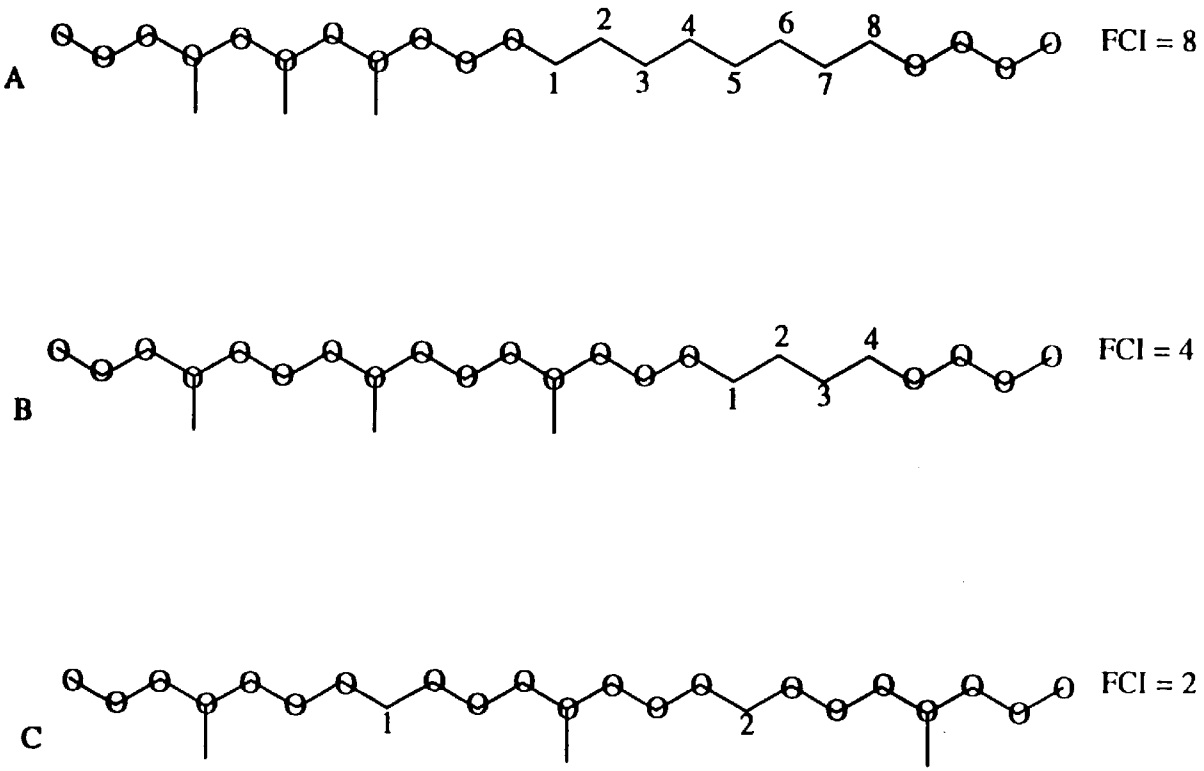
FIG. 1 provides a schematic representation of three isoparaffins each having a different Free Carbon Index (for A FCI=8; B FCI=4; C FCI=2).

This invention is particularly applicable to waxy hydrocarbons including slack wax, Fischer-Tropsch wax, waxy raffinates and waxy distillates containing 50 wt % or more of wax. For the purposes of this invention the wax content of the feed refers to the amount of the material that can be removed therefrom under solvent dewaxing to a −20° C. pour point.

Accordingly feeds containing 50 wt % or more of wax are upgraded by a process comprising the steps of hydrotreating the feed to produce a material of reduced sulfur and nitrogen, hydroisomerizing the hydrotreated material over a low fluorine content, alumina based, hydroisomerization catalyst to reduce the wax content to less than about 40 wt %. The feed is then separated into a fraction boiling below about 340° C. and a lube fractions boiling above about 340° C. The lube fraction is further processed over a catalyst comprising a mixture of a catalytically active metal component on a zeolite dewaxing catalyst and a catalytically active metal component on an amorphous catalyst. Optionally, the lube fraction is first solvent dewaxed before further processing. Those steps are set forth in greater detail below.

Hydrotreating

Hydrotreating can be conducted under typical hydrotreating conditions to reduce sulfur and nitrogen contents to levels of 5 ppmw or less nitrogen and 5 ppmw or less sulfur. Any of the conventional hydrotreating catalysts can be employed, like Ni/Mo on alumina, Ni/W on alumina, Co/Mo on alumina, etc.; in other words any of the Group VIB-Group VIII metals (Sargent-Welch periodic table) on refractory metal oxide. Commercial examples of such catalysts are identified as HDN-30 and KF-840.

Waxy feeds secured from natural petroleum sources contain quantities of sulfur and nitrogen compounds which are known to deactivate wax hydroisomerization catalysts. To prevent this deactivation it is preferred that the feed contain no more than 10 ppm sulfur, preferably less than 2 ppm sulfur and no more than 2 ppm nitrogen, preferably less than 1 ppm nitrogen.

To achieve these limits the feed is preferably hydrotreated to reduce the sulfur and nitrogen content.

Hydrotreating can be conducted using any typical hydrotreating catalyst such as Ni/Mo on alumina, Co/Mo on alumina, Co/Ni/Mo on alumina, e.g., KF-840, KF-843, HDN-30, HDN-60, Criteria C-411, etc. Similarly, bulk catalysts comprising Ni/Mn/Mo or Cr/Ni/Mo sulfides as described in U.S. Pat. No. 5,122,258 can be used.

Hydrotreating is performed at temperatures in the range 280° C. to 400° C., preferably 340° C. to 380° C. at pressures in the range 500 to 3000 psi, hydrogen treat gas rate in the range of 500 to 5000 SCF/bbl and a flow velocity in the range 0.1 to 5 LHSV, preferably 1 to 2 LHSV.

The hydrotreated waxy feed is stripped to remove $NH_3$ and $H_2S$ and then hydroisomerized over a hydroisomerization catalyst.

Hydroisomerization

The hydroisomerization catalyst typically will comprise a porous refractory metal oxide support such as alumina, silica-alumina, titania, zirconia, etc. which contains an additional catalytic component selected from at least one of Group VI B, Group VII B, Group VIII metals, preferably a Group VIII metal, more preferably a noble Group VIII metal, most preferably platinum and palladium present in an amount in the range of 0.1 to 5 wt %, preferably 0.1 to 2 wt % most preferably 0.3 to 1 wt % and which also may contain promoters and/or dopants selected from the group consisting of halogen, phosphorous, boron, yttria, rare-earth oxides and magnesia preferably halogen, yttria, magnesia, most preferably fluorine, yttria, magnesia. When halogen is used it is present in an amount in the range 0.1 to 10 wt %, preferably 0.1 to 5 wt %, more preferably 0.1 to 2 wt % most preferably 0.5 to 1.5 wt %. If the metal component is Group VIB, non-noble metal Group VIII or mixture thereof, then the amount of metal can be increased up to 30 wt %.

For those catalysts which do not exhibit or demonstrate acidity, for example gamma-alumina, acidity can be imparted to the catalyst by use of promoters such as fluorine, which are known to impart acidity, according to techniques well known in the art. Thus, the acidity of a platinum on alumina catalyst can be very closely adjusted by controlling the amount of fluorine incorporated into the catalyst. Similarly, the catalyst particles can also comprise materials such as catalytic metal incorporated onto silica-alumina. The acidity of such a catalyst can be adjusted by careful control of the amount of silica incorporated into the silica-alumina base or by starting with a high acidity silica-alumina catalyst and reducing its acidity using mildly basic dopants such as yttria or magnesia, as taught in U.S. Pat. No. 5,254,518 (Soled, McVicker, Gates and Miseo).

Hydroisomerization is conducted at a temperature between about 200° C. to 400° C., preferably 250° C. to 380° C., and most preferably 300° C. to 350° C. at hydrogen partial pressures between about 350 to 5000 psig (2.41 to 34.5 mPa), preferably 1000 to 2500 psig (7.0 to 17.2 mPa), a hydrogen gas treat rate of 500 to 10,000 SCF $H_2$/bb (89 to 1780 $m^3/m^3$), preferably 2,000 to 5,000 SCF $H_2$/B (356 to 890 $m^3/m^3$), and a LHSV of 0.1 to 10 v/v/hr, more preferably 0.5 to 5 v/v/hr, most preferably 1 to 2 v/v/hr.

In the embodiment of the invention in which the hydroisomerized feed is subjected to a solvent dewaxing step then the wax content preferably will be reduced to about 40 wt %, more preferably to about 35 wt %; otherwise it most preferably is reduced to about 25 wt %.

Separation

The hydroisomerized feed preferably is separated into a fraction boiling below about 340° C. and a lube fraction boiling above about 340° C. by any conventional means, for example, by distillation.

Solvent Dewaxing Embodiment

In one embodiment, the lube fraction is then dewaxed under standard solvent dewaxing conditions to a pour point in the order of less than about +10° C., and preferably 0° C. and less.

The dewaxing solvent used may include the $C_3$–$C_6$ ketones such as methyl ethyl ketone (MEK), methyl isobutyl ketone (MIBK), mixtures of MEK and MIBK, aromatic hydrocarbons like toluene, mixtures of ketones and aromatics like MEK/toluene, ethers such as methyl t-butyl ethers and mixtures of same with ketones or aromatics. Similarly, liquefied, normally gaseous hydro-carbons like propane, propylene, butane, butylene, and combinations thereof may be used as the solvent. Preferably the solvent employed will be an equal volume mixture of methyl ethyl ketone and methyl isobutyl ketone. Typically the isomerate to solvent ratio will range between 1 to 10 and preferably will be about 1:3. The dewaxed feed is then subjected to hydrocatalytic dewaxing as described hereinafter.

Direct Dewaxing Embodiment

In another embodiment of the present invention, the lube fraction is subjected to hydrocatalytic dewaxing directly, i.e., without being first subjected to solvent dewaxing. The hydrocatalytic dewaxing, in either instance, is the same and as described hereinafter.

Hydrocatalytic Dewaxing

The solvent dewaxed feed or the lube fraction is subjected to hydrocatalytic dewaxing using a catalyst comprising a catalytically active metal component on a zeolite dewaxing catalyst and a catalytically active metal on an amorphous, alumina based, isomerization catalyst. Preferably, the mixed catalyst is a unitized mixed powder catalyst. The term "unitized" as used here means that each pellet is one made by mixing together powdered molecular sieve dewaxing catalyst(s) with powdered amorphous isomerization catalyst (s) and pelletizing the mixture to produce pellets each of which contain all of the powder components previously recited.

The unitized powder pellet catalyst has been found to produce superior results as compared to using individual catalysts corresponding to the separate components of the mixed powder unitized pellet catalyst.

The unitized catalyst can be prepared by starting with individual finished catalysts, pulverizing and powdering such individual finished catalysts, mixing the powdered materials together to form a homogeneous mass, then compressing/extruding and pelleting thus producing the unitized pellet catalysts comprising a mixture of the individual, different, and distinct catalyst components. Pulverizing and powdering is to a consistency achievable using a mortar and pestle or other such conventional powdering means.

Alternatively, individual finished catalysts can be pulverized and powdered then the powdered materials can be mixed together, boehmite or pseudo boehmite powder can be added to the powder mix, the mix can then be compressed/extruded and pelleted and the pellet calcined to convert the boehmite/pseudo-boehmite into alumina resulting in the production of a physically strong, attrition resistant unitized pellet catalyst.

The unitized pellet catalyst can be prepared from a wide variety of individual dewaxing and isomerization catalysts.

The dewaxing catalyst is a 10 member ring unidirectional inorganic oxide molecular sieve having generally oval 1-D pores having a minor axis between about 4.2 Å and about 4.8 Å and a major axis between about 5.4 Å and about 7.0 Å as determined by X-ray crystallography. The molecular sieve is preferably impregnated with from 0.1 to 5 wt %, more preferably about 0.1 to 3 wt % of at least one Group VIII metal, preferably a noble Group VIII metal, most preferably platinum or palladium.

While the effective pore size as discussed above is important to the practice of the invention not all intermediate pore size molecular sieves having such effective pore sizes are advantageously usable in the practice of the present invention. Indeed, it is essential that the intermediate pore size molecular sieve catalysts used in the practice of the present invention have a very specific pore shape and size as measured by X-ray crystallography. First, the intracrystalline channels must be parallel and must not be interconnected. Such channels are conventionally referred to as 1-D diffusion types or more shortly as 1-D pores. The classification of intrazeolite channels as 1-D, 2-D and 3-D is set forth by R. M. Barrer in Zeolites, Science and Technology, edited by F. R. Rodgrigues, L. D. Rollman and C. Naccache, NATO ASI Series, 1984 which classification is incorporated in its entirety by reference (see particularly page 75).

The second essential criterion as mentioned above is that the pores must be generally oval in shape, by which is meant the pores must exhibit two unequal axes, referred to herein as a minor axis and a major axis. The term oval as used herein is not meant to require a specific oval or elliptical shape but rather to refer to the pores exhibiting two unequal axes. Thus, as previously stated the 1-D pores of the catalysts useful in the practice of the present invention must have a minor axis between about 4.2 Å and about 4.8 Å and major axis between 5.4 Å and about 7.0 Å as determined by conventional X-ray crystallography measurements.

Zeolites which are considered to be in this pore range include ZSM-5, ZSM-11, etc. However, upon careful examination of the intermediate pore size zeolites it has been found that not all of them are efficient as a catalyst for isomerization of a paraffin-containing feedstock. The intermediate pore size zeolites forming part of the present invention are those which in addition to having the correct pore size are also unidirectional. Such 10 member ring, uni-directional zeolites include ZSM-22, ZSM-23, ZSM-35, ferrierite, ZSM-48, and clinoptiolite and materials isostructural with these as defined Atlas of Zeolite Structure types by S. M. Mier and D. H. Olson., Third Revised Edition 1992.

The most preferred intermediate pore size silicoaluminophosphate molecular sieve for use in the process of the invention is SAPO-11. SAPO-11 comprises a molecular framework of corner-sharing ($SiO_2$) tetrahedra, ($AlO_2$) tetrahedra and ($PO_2$) tetrahedra. Other silicoaluminaphosphates molecular sieves include SAPO-31 and SAPO-41.

The isomerization catalyst component can be any of the typical isomerization catalyst such as those comprising refractory metal oxide support base (e.g., alumina, silica-alumina, zirconia, titanium, etc.) on which has been deposited a catalytically active hydrogenation metal selected from Group VI B, Group VII B, Group VIII metals and mixtures thereof, preferably Group VIII, more preferably noble Group VIII, most preferably Pt or Pd and optionally including a promoter or dopant such as halogen, phosphorous, boron, yttria, magnesia, etc., preferably halogen, yttria or magnesia, most preferably fluorine. The catalytically active metals are present in the range 0.1 to 5 wt %, preferably 0.1 to 3 wt %, more preferably 0.1 to 2 wt %, most preferably 0.1 to 1 wt %. The promoters and dopants are used to control the acidity of the isomerization catalyst. Thus, when the isomerization catalyst employs a base material such as alumina, acidity is imparted to the resultant catalyst by addition of a halogen, preferably fluorine. When a halogen is used, preferably fluorine, it is present in an amount in the range 0.1 to 10 wt %, preferably 0.1 to 3 wt %, more preferably 0.1 to 2 wt % most preferably 0.5 to 1.5 wt %. Similarly, if silica-alumina is used as the base material, acidity can be controlled by adjusting the ratio of silica to alumina or by adding a dopant such as yttria or magnesia which reduces the acidity of the silica-alumina base material as taught on U.S. Pat. No. 5,254,518 (Soled, McVicker, Gates, Miseo). As with the dewaxing catalyst composite, one or more isomerization catalysts can be pulverized and powdered, and mixed producing the second component of the unitized mixed pellet catalyst.

The isomerization catalyst can also be the mixture of discrete particle pair catalysts described and claimed in U.S. Pat. No. 5,565,086. That catalyst comprises a mixture of discrete particles of two catalysts having acidities in the range 0.3 to 2.3 wherein the catalysts of the catalyst pair have acidities differing by about 0.1 to about 0.9 wherein acidity is determined by the technique of McVicker-Kramer as described in "Hydride Transfer and Olefin Isomerization as Tools to Characterize Liquid and Solid Acids, Acc. Chem. Res. 19, 1986, pp. 78–84. In general one of the catalysts is deemed to be a high acidity catalyst having an acidity as evidenced by having a 3-methylpent-2-ene to 4-methylpent-2-ene ratio in the range 1.1 to 2.3 where as the other catalyst will be a low acidity catalyst as evidenced by having a 3-methylpent-2-ene to 4-methylpent-2-ene ratio in the range 0.3 to about 1.1.

This method measures the ability of catalytic material to convert 2-methylpent-2-ene into 3-methylpent-2-ene and 4-methylpent-2-ene. More acidic materials will produce more 3-methylpent-2-ene (associated with structural rearrangement of a carbon atom on the carbon skeleton). The ratio of 3-methylpent-2-ene to 4-methylpent-2-ene formed at 200° C. is a convenient measure of acidity. Isomerization catalyst acidities as determined by the above technique lies in the ratio region in the range of about 0.3 to about 2.5, preferably about 0.5 to about 2.0. Dewaxing catalysts have acidities, as determined by the above technique which lie in the ratio region in the range of about 2.5 to 3.0, preferably 2.6 to 2.8.

For a number of catalysts the acidity as determined by the McVicker/Kramer method, i.e., the ability to convert 2-methylpent-2-ene into 3-methylpent-2-ene and 4-methylpent-2-ene at 200° C., 2.4 w/h/w, 1.0 hour on feed wherein acidity is reported in terms of the mole ratio of 3-methylpent-2-ene to 4-methylpent-2-ene, has been correlated to the fluorine content of platinum on fluorided alumina catalyst and to the yttria content of platinum on yttria doped silica/alumina catalysts. This information is reported below.

Acidity of 0.3% Pt on fluorided alumina at different fluorine levels:

| F Content (%) | Acidity (McVicker/Kramer) |
|---|---|
| 0.5 | 0.5 |
| 0.75 | 0.7 |
| 1.0 | 1.5 |
| 1.5 | 2.5 |
| 0.83 | 1.2 (interpolated) |

Acidity of 0.3% Pt on yttria doped silica/alumina initially comprising 25 wt % silica:

| Yttria Content (%) | Acidity (McVicker/Kramer) |
|---|---|
| 4.0 | 0.85 |
| 9.0 | 0.7 |

The hydrocatalytic dewaxing is conducted at a temperature between about 200° C. to 400° C., preferably 250° C. to 380° C. and most preferably 300° C. to 350° C., a hydrogen partial pressure between about 350 to 5000 psig (2.41 to 34.6 mPa), preferably 1000 to 2500 psig (7.0 to 17.2 mPa), a hydrogen gas treat rate of 500 to 10,000 SCF $H_2$/bbl (89 to 178 $m^3/m^3$, preferably 2,000 to 5,000 SCF $H_2$/bbl (356 to 890 $m^3/m^3$), and a LHSV of 0.1 to 10 v/v/hr, preferably 0.5 to 5 v/v/hr, most preferably 1 to 2 v/v/hr.

Product Characterization

The resultant basestock of the process of the present invention comprises at least about 75 wt % of iso-parafins but has a unique structural character. Basically, the basestock has a "Free Carbon Index" (or FCI) typically in the range of 4 to 12, preferably less than 10. The term "Free Carbon Index" is a measure of the number of carbons in an iso-paraffin that are located at least 3 carbons from a terminal carbon and more than 3 carbons away from a side chain. The FCI of an isoparaffin can be determined by measuring the percent of methylene groups in an isoparaffin sample using $^{13}$C NMR (400 megahertz); multiplying the resultant percentages by the calculated average carbon number of the sample determined by ASTM Test method 2502 and dividing by 100. A further criterion which differentiates these materials structurally from poly alpha olefins is the branch length. Interestingly, in the basestocks of this invention, at least 75% of the branches, as determined by NMR, are methyls and the population of ethyl, propyl and butyls, etc., fall sharply with increasing molecular weight to the point where no more than 5% are butyls. Typically the ratio of "free carbons" to end methyl is in the range of 2.5 to 4.0. Additionally, the basestocks of this invention typically have, on average, from 2.0 to 4.5 side chains per molecule.

In contrast, polyalpha-olefin (PAO) basestocks have fewer (about one) and longer branches or side chains. Indeed the ratio of "free carbons" to end methyl ranges from 1.1 to 1.7.

The FCI is further explained as follows. The basestock is analyzed by $^{13}$CNMR using a 400 MHz spectrometer. All normal paraffins with carbon numbers greater than $C_9$ have only five non-equivalent NMR adsorptions corresponding to the terminal methyl carbons ($\alpha$) methylenes from the second, third and forth positions from the molecular ends ($\beta$, $\gamma$, and $\delta$ respectively), and the other carbon atoms along the backbone which have a common chemical shift ($\epsilon$). The intensities of the $\alpha$, $\beta$, $\gamma$ and $\delta$ are equal and the intensity of the $\epsilon$ depends on the length of the molecule. Similarly the side branches on the backbone of an iso-paraffin have unique chemical shifts and the presence of a side chain causes a unique shift at the tertiary carbon (branch point) on the backbone to which it is anchored. Further, it also perturbs the chemical sites within three carbons from this branch point imparting unique chemical shifts ($\alpha'$, $\beta'$, and $\gamma'$).

The Free Carbon Index (FCI) is then the percent of $\epsilon$ methylenes measured from the overall carbon species in the $^{13}$CNMR spectra of the a basestock, divided by the average carbon Number of the basestock as calculated from ASTM method 2502, divided by 100. This is further illustrated in FIG. 1 which shows the FCI for three compounds having FCI's ranging from 8 to 2 (A=8, B=4, C=2). In FIG. 1, 0=carbon atoms near branches/ends; 1–8=free carbon atoms. Thus, e.g., the FCI of A is calculated as $((8/26)\times100)\times(26/100)=8$.

Even after very low conversion levels (<10%), the value of $\epsilon$ falls by nearly 50% and there is a large increase in the side chain fraction, larger in fact than that observed in a product that has been severely isomerized (>70% conversion to 370° C.–) and solvent dewaxed. The increase in sidechains is almost exclusively in methyl sidechains. There is a much larger percentage of terminal end groups and the distinction between a methyl at the second or third carbons from the end drops significantly. Roughly 35% of the added sidechains have been added to the last four terminal carbons.

Figure 2:
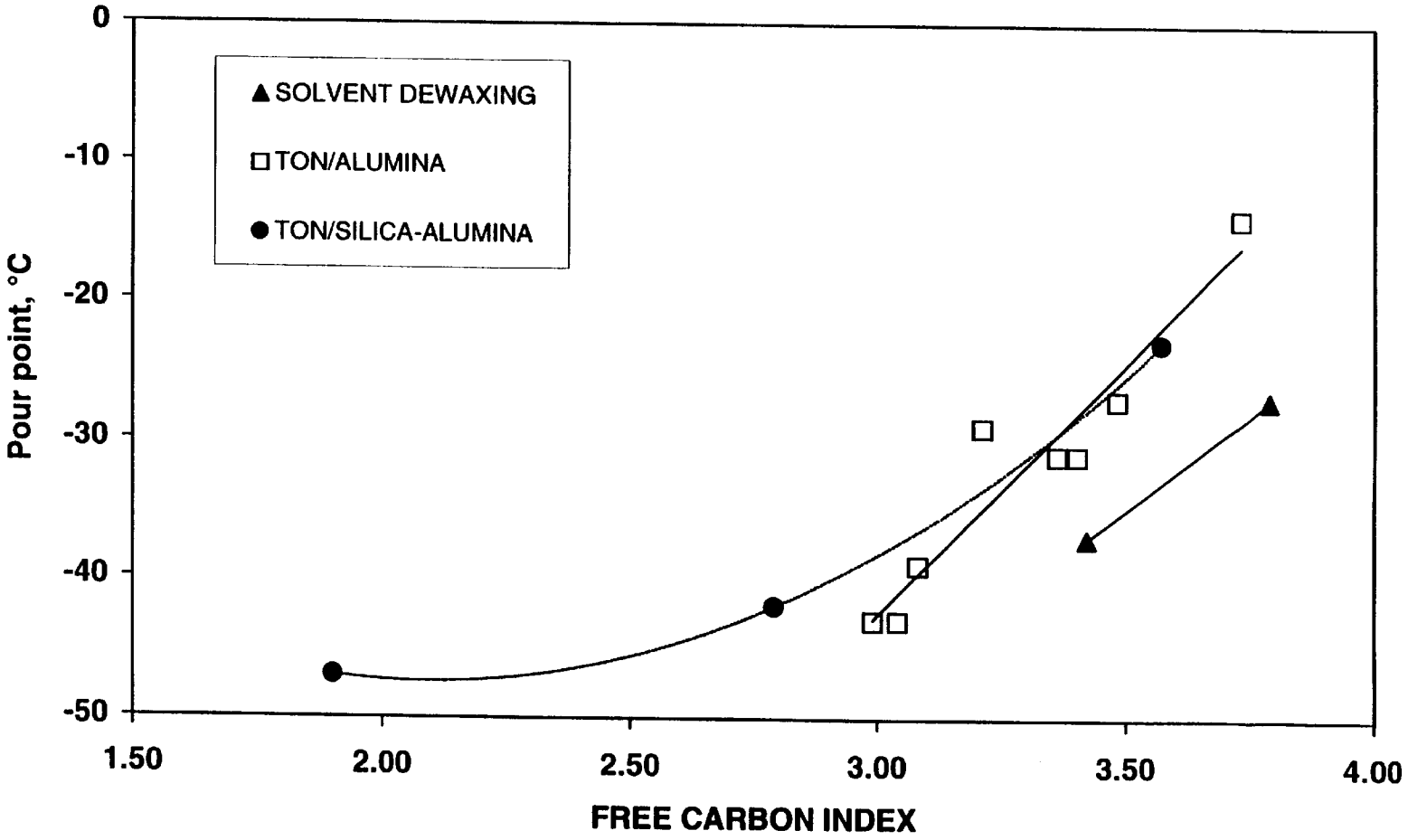
FIG. 2 is a plot of pour point (° C.) versus Free Carbon Index.
Figure 3:
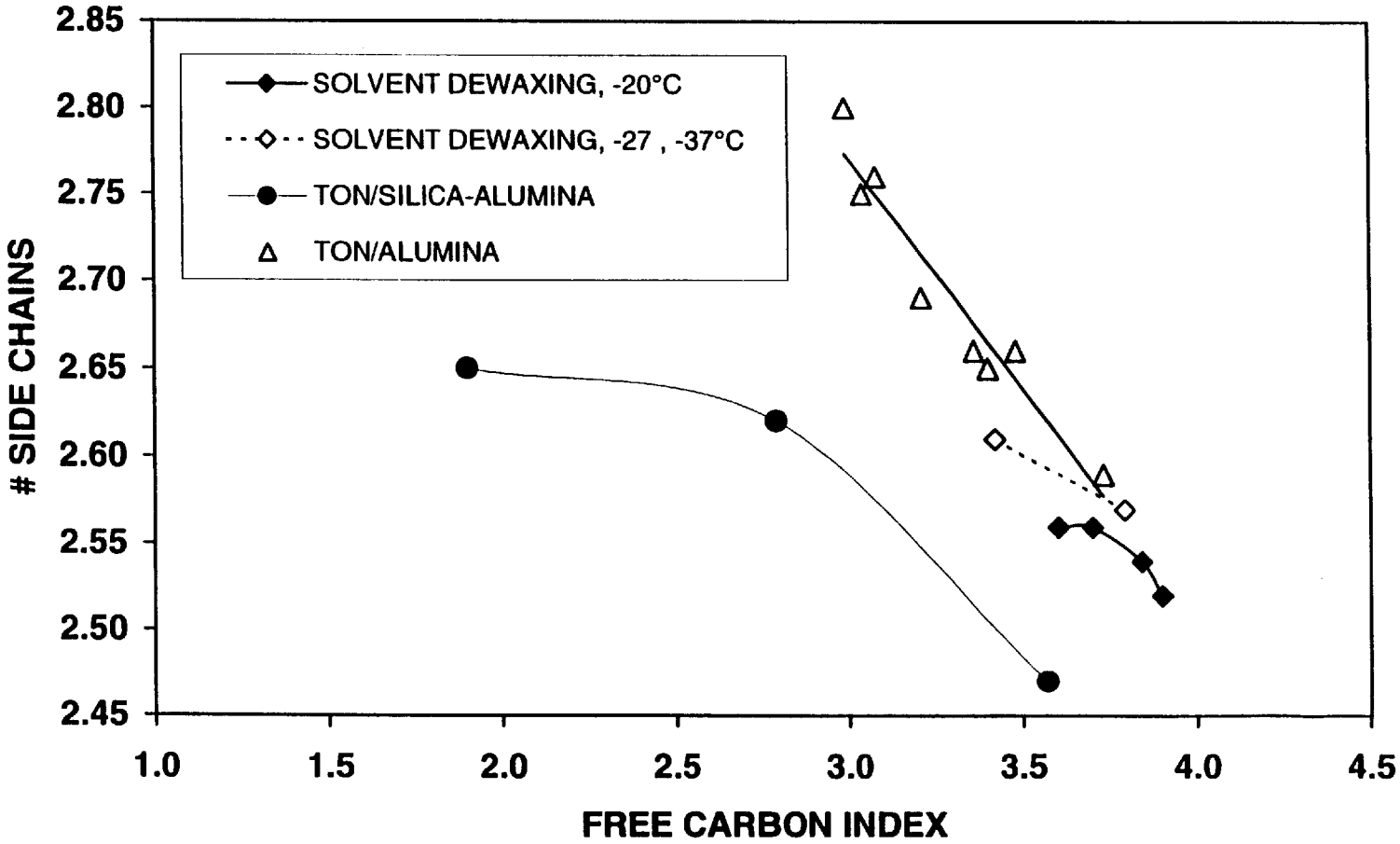
FIG. 3 is a plot of the number of side chains versus Free Carbon Index.
Figure 4:
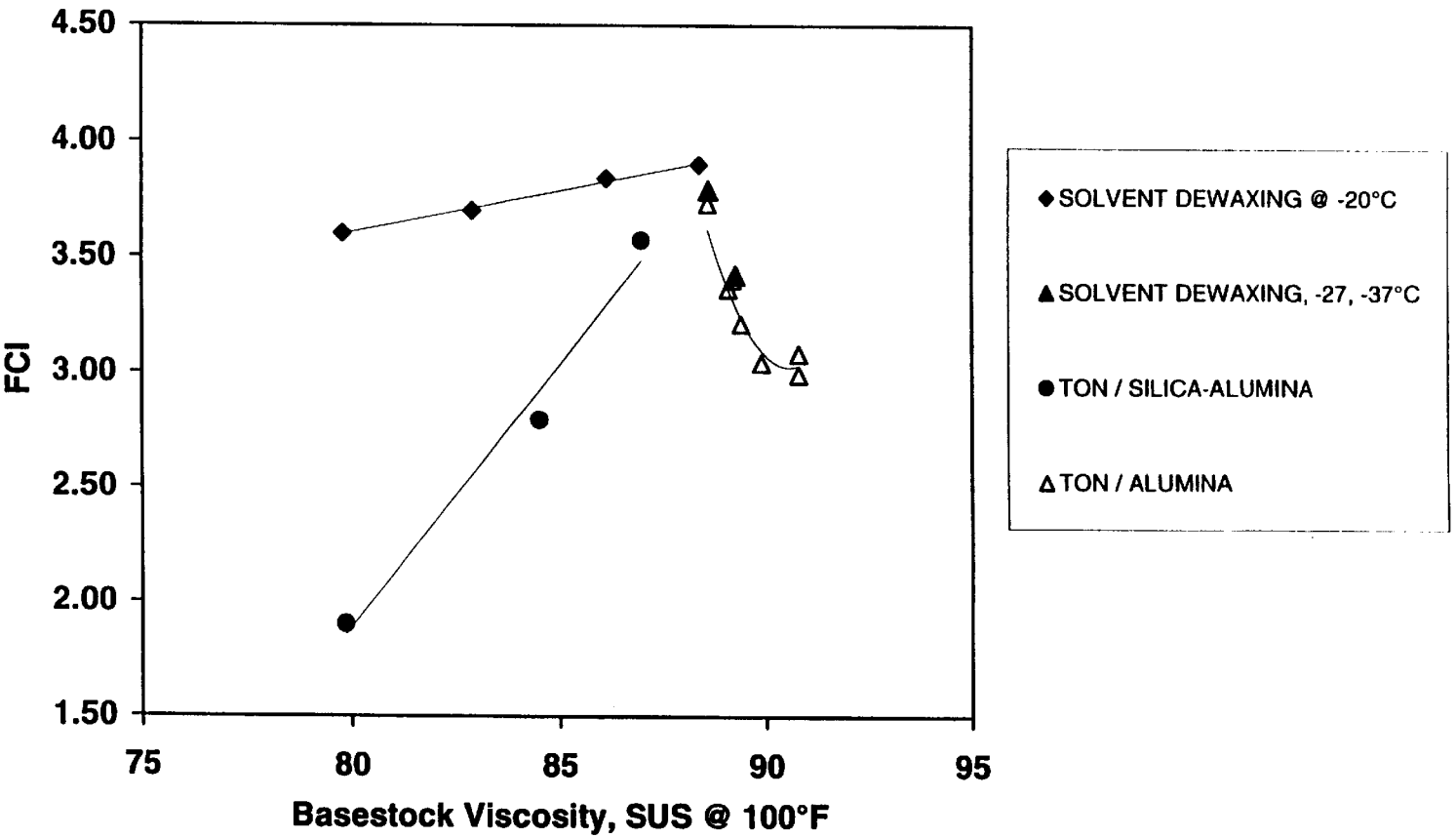
FIG. 4 is a plot of Free Carbon Index versus basestock viscosity (SUS at 100° F.).

FIGS. 2 to 4 serve to illustrate the relationship between Free Carbon Index (FCI), pour point, the average number of sidechains per molecule and basestock viscosity, SUS at 100° F.

FIG. 2 shows that at constant pour point the FCI of solvent dewaxed basestock (blackened triangles) is lower than that of catalytically dewaxed basestock. FIG. 2 further shows that when a zeolite is admixed with a more acidic component, silica-alumina, to form a unitized catalyst (open squares) versus a less acidic component, alumina (blackened circles), that the FCI decreases to much lower values as pour point decreases.

FIG. 3 shows that at constant FCI the average number of side-chains per molecule is of hydrocatalytically dewaxed basestocks is lower than basestocks derived from solvent dewaxing at −20° C. (blackened diamonds) and at −27° C. and −37° C. open diamonds) when the unitized catalyst is composed of a zeolite admixed with a more acidic component, silica-alumina (blackened circles). FIG. 3 further shows that basestocks derived from the unitized catalyst is composed of a zeolite admixed with a less acidic component, alumina (open triangles), have FCI's higher than basestocks derived from solvent dewaxing.

FIG. 4 shows the relationship between Free Carbon Index (FCI) and basestock viscosity (SUS at 100° F.) and illustrates the differences between solvent dewaxing and catalytic dewaxing. Open triangles indicate TON/alumina, blackened triangles indicate solvent dewaxing at −27, −37° C. blackened diamonds indicate solvent dewaxing at about −20° C. and blackened circles indicate TON/silica-alumina.

The following examples further serve to illustrate, but not limit this invention.

EXAMPLE 1

In this Example, 150N slack wax having an oil content of 10.7% was hydrotreated in a series of runs over KF-840 catalyst at LHSV of 1.0 v/v/hr, Hydrogen treat gas rate of 2500 scf $H_2$/bbl, hydrogen pressure of 1000 psig and temperature of 365° C. at which condition the nitrogen content of the stripped product was less than 4 wppm. This stripped product was then contacted with a 0.3 wt % Pt/F/Alumina catalyst under the conditions listed on Table 1 to produce a series of waxy isomerates with the properties shown in Table 2. These waxy isomerate products were solvent dewaxed to −21° C. using methyl ethyl ketone/methyl isobutyl ketone (50/50 v/v) and an oil to solvent ratio of 1:3 and then formulated as an Automatic Transmission Fluid (ATF) using Hitec 434 (Ethyl Corp) in the ratio of oil to adpack of 3 to 1 by weight. The properties of each blend are shown in Table 2. Table 2 shows that as conversion to 370° C.− increases from 24 to 75%, yields on feed decrease from 51 to 11 wt %. The table also shows that as conversion increases, the Brookfield Viscosities at −40° C. decrease from 12680 to 4480 cP.

TABLE 1

| CONDITIONS | Run 1 | Run 2 | Run 3 | Run 4 |
|---|---|---|---|---|
| Reactor Temperature, ° C. | | | | |
| Pressure (psig) | 1000 | 1000 | 1000 | 1000 |
| Gas Rate (SCF/$BH_2$) | 2500 | 2500 | 2500 | 2500 |
| Space Velocity, v/v/hr | 1.3 | 1.3 | 1.3 | 1.3 |

TABLE 2

Isomerate Properties

| | Run 1 | Run 2 | Run 3 | Run 4 |
|---|---|---|---|---|
| Conversion (HIVAC) | 75 | 50 | 35 | 24 |
| Yield on Feed, wt % | 11 | 23 | 31 | 51 |
| Viscosity at 40° C. | 15.24 | 15.48 | 14.93 | 15.05 |
| Viscosity at 100° C. | 3.62 | 3.68 | 3.83 | 3.68 |
| Viscosity Index | 122 | 126 | 129 | 134 |
| Pour Point (° C.) | −24 | −22 | −22 | −20 |
| Cloud Point (° C.) | −19.1 | −17.2 | −17.8 | −16.8 |
| GCD Noack at 250° C. | 19.6 | 17 | 18.8 | 17.1 |
| MBP (° C.) | 411.3 | 415.1 | 415.1 | 416.7 |
| FCI | 2.5 | 2.39 | 2.64 | 4.43 |

| | Blend 1 | Blend 2 | Blend 3 | Blend 4 |
|---|---|---|---|---|
| Viscosity at 40° C. | 27.50 | 27.79 | 27.26 | 27.09 |
| Viscosity at 100° C. | 6.83 | 6.93 | 6.83 | 6.90 |
| Viscosity Index | 224 | 227 | 227 | 233 |
| Pour Point (° C.) | −60 | −54 | −52 | −46 |
| Cloud Point (° C.) | −24.9 | −20.4 | −20.7 | −16.7 |
| Brookfield Viscosity, cP at −40° C. | 4480 | 5930 | 7680 | 12680 |

EXAMPLE 2

In this example, a series of runs were conducted using a hydro-treated and stripped feed as in Example 1. The feed was then treated with the same catalyst of Example 1 to 35% conversion to 370° C.− isomerate under the conditions listed in Table 1, Run 3.

The isomerate product was stripped to 370° C.+ and then solvent dewaxed as in Example 1 yielding a basestock with properties similar to that for Run 3. Subsequently, three batches of this product were processed separately (runs 5 to 7) over an hydrocatalytic dewaxing catalyst comprising 25% Pd/Theta-1 zeolite, $H^+$ form (Si/Al ratio=60) blended with 75% of an isomerization catalyst comprising 0.3% Pt on fluorided alumina (1.0% of fluoride on alumina). The conditions for the series are given in Table 3.

TABLE 3

| CONDITIONS | Run 5 | Run 6 | Run 7 |
|---|---|---|---|
| Reactor Temperature, ° C. | 280 | 310 | 325 |
| Pressure (psig) | 1000 | 1000 | 1000 |
| Gas Rate (SCF/$BH_2$) | 1200 | 1200 | 1200 |
| Space Velocity, v/v/hr | 1.0 | 1.0 | 1.0 |

The properties of the hydrocatalytic dewaxed products are given in Table 4.

TABLE 4

Properties of Isomerate Base Stock Following Hydrocatalytic Dewaxing

| PROPERTIES | Example 5 | Example 6 | Example 7 | PAO |
|---|---|---|---|---|
| Base Stock | Run 5 | Run 6 | Run 7 | PAO |
| Conversion (HIVAC) | 2.9 | 4 | 4.02 | |
| Yield on/somerate Feed | 97.1 | 96.0 | 95.08 | N/A |
| Viscosity at 40° C. | 16.61 | 15.64 | 15.76 | 17.18 |
| Viscosity at 100° C. | 3.89 | 3.69 | 3.68 | 3.88 |
| Viscosity Index | 131 | 124 | 121 | 121 |
| Pour Point (° C.) | −31 | −43 | −44 | −60 |
| Noack at 250° C. | 17.6 | 19.1 | 19.7 | — |
| FCI | | 2.62 | | |

The hydrocatalytically dewaxed base stock were formulated as an ATF as in Example 1. The properties of the formulated basestocks of Table 4 are shown in Table 5 along with those for a PAO sold by Mobil Chemical Company, New York.

TABLE 5

Formulated Blend Properties

| | Blend 5 | Blend 6 | Blend 7 | Blend 8 PAO 4 |
|---|---|---|---|---|
| Basestock | Run 5 | Run 6 | Run 7 | PAO 4 |
| Viscosity at 40° C. | 39.56 | 28.48 | 28.48 | 29.25 |
| Viscosity at 100° C. | 7.22 | 6.97 | 6.95 | 7.07 |
| Viscosity Index | 224 | 222 | 221 | 219 |
| Pour Point (° C.) | −50 | <−64 | <−61 | <−68 |
| Cloud Point (° C.) | −26 | −36 | −41 | −49.8 |
| Brookfield Viscosity, cP at −40° C. | 6020 | 4710 | 4680 | 3350 |

Surprisingly, the blend with the lowest Brookfield Viscosity contains basestocks derived from the hydrocatalytic dewaxing process at lowest severity. The FCI of basestock 5 is 2.62, illustrating the superior properties of the product and the unique character of the basestock.

EXAMPLE 3

In this example a waxy isomerate total liquid product was produced from a 600N slack wax by hydrotreating over a Ni/Mo alumina catalyst (KF-840) under the hydrotreating conditions listed in Table 6. Nitrogen and sulfur were reduced to less than 2 wppm.

The total liquid product from hydrotreating and stripping was then passed over a fluorided alumina (0.3 wt % Pt/1.0 wt % F/Alumina) under the hydromerization conditions listed in Table 6. These conditions produced a waxy isomerate with a conversion to 370° C.− of 17.5%. This product was stripped to remove 370° C.− material, then solvent dewaxed. In a series of runs the isomerate so produced was subjected to hydrocatalytic dewaxing over a mixed powdered dewaxing catalyst (0.25 wt % Pd Theta-1 (TON)/0.3 wt % Pt/1.0 wt % F/alumina) at conditions shown in Table 7. After removal by stripping, of 370° C. material, the products had the properties shown in Table 7.

TABLE 6

| HYDROTREATING | |
|---|---|
| Feed: | 600N Slack Wax, 11% Oil in Wax |
| Catalyst: | KF-840 |
| Conditions | |
| Temperature, ° C. | 345 |
| Pressure, MPa | 6.9 |
| Feed Rate, v/v/hr | 0.7 |
| Gas Rate, SCF/bbl | 1500 |
| **HYDROISOMERIZATION** | |
| Feed: | Hydrotreated 600N Slack Wax, (above) |
| Catalyst: | 0.3 wt % Pt/ 1.0 wt % F/Alumina |
| Conditions: | |
| Temperature, ° C. | 340 |
| Pressure, MPa | 6.9 |
| Feed Rate, v/v/hr | 1.3 |
| Gas Rate, SCF/bbl | 2500 |
| % Conversion to 370° C.- | 17.5 |

TABLE 7

| CONDITIONS | Run 9 | Run 10 | Run 11 | Run 12 |
|---|---|---|---|---|
| HYDROCATALYTIC DEWAXING CONDITIONS | | | | |
| Average Reactor Temperature, (° C.) | 327 | 321 | 347 | 345 |
| LHSV | 1 | 1 | 2.6 | 2.6 |
| Gas Rate (SCF/B) | 2500 | 2500 | 1000 | 1000 |
| Pressure (psig) | 1000 | 1000 | 1000 | 1000 |
| % Conversion, to 370° C.- | 23.4 | 23.5 | 25.6 | 25.3 |
| PRODUCT QUALITY | | | | |
| Viscosity at 40° C. | 30.03 | 29.7 | 29.14 | 29.47 |
| Viscosity at 100° C. | 5.77 | 5.73 | 5.66 | 5.72 |
| VI | 137 | 138 | 138 | 139 |
| Pour Point (° C.) | −27 | −26 | −25 | −25 |
| Cloud Point (° C.) | n/a | n/a | −14.8 | −12 |

What is claimed is:

1. A method for producing a lube basestock from a feed containing 50 wt % or more of wax comprising:

(a) hydrotreating the feed under hydrotreating conditions so as to reduce the sulfur and nitrogen content thereof;

(b) hydroisomerizing the hydrotreated feed under hydroisomerization conditions to reduce the wax content in the feed to less than about 40 wt %;

(c) separating the hydroisomerizated feed of step (b) to obtain a lube fraction boiling above about 340° C.;

(d) processing the lube fraction of step (c) under hydrocatalytic dewaxing conditions with a catalyst comprising at least one active metal hydrogenation component on a dewaxing catalyst and at least one active metal hydrogenation component on an amorphous hydroisomerization catalyst.

2. The method of claim 1 wherein the catalyst in step (d) is a unitized powder pellet catalyst comprising a dewaxing catalyst which contains at least one active metal hydrogenation component on a 10 member ring unidirectional pore inorganic oxide molecular sieve, and an amorphous isomerization catalyst which contains at least one active metal hydrogenation component on an isomerization component selected from refractory metal oxides and refractory metal oxides including a dopant.

3. The method of claim 2 wherein the amorphous isomerization catalyst has an acidity of about 0.3 to about 2.5 wherein said acidity is determined by the ability of the isomerization catalyst to convert 2-methylpent-2-ene to 3-methylpent-2-ene and 4-methylpent-2-ene and is expressed as the mole ratio of 3-methylpent-2-ene and 4-methylpent-2-ene.

4. The method of claim 1 wherein the lube fraction of step (c) is first solvent dewaxed before processing in step (d).

5. The method of claim 3 wherein the active metal component is at least one of a Group VIB or Group VIII metal.

6. The method of claim 1 wherein the lube basestock contains at least 75 wt % iso-paraffins.

7. A method for producing a lube basestock from a feed containing 50 wt % or more of wax comprising:

(a) hydrotreating waxy feed under hydrotreating conditions sufficient to reduce the sulfur and nitrogen content thereof to produce a hydrotreated feed;

(b) hydroisomerizing the hydrotreated feed under hydroisomerization conditions sufficient to reduce the wax content in the feed to about 35 wt % or less;

(c) separating the hydroisomerized feed of step (b) to obtain a lube fraction boiling above about 340° C.;

(d) solvent dewaxing the lube fraction to a pour point of from about +10° C. to about −20° C. to obtain a dewaxed feed;

(e) processing the dewaxed feed under hydrocatalytic dewaxing conditions with a unitized powder pellet catalyst comprising at least one active metal component on a 10 member ring unidirectional pore inorganic oxide molecular sieve and at least one active metal component on an isomerization component selected from refractory metal oxides and refractory metal oxides including a dopant.

* * * * *